US011015620B2

(12) United States Patent
Gellner et al.

(10) Patent No.: US 11,015,620 B2
(45) Date of Patent: May 25, 2021

(54) SERVOHYDRAULIC DRIVE

(71) Applicant: Robert Bosch GmbH, Stuttgart (DE)

(72) Inventors: Thomas Gellner, Steinfeld (DE); Gottfried Hendrix, Gemuenden (DE); Michael Goldbach, Lohr A. Main (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/660,565

(22) Filed: Oct. 22, 2019

(65) Prior Publication Data

US 2020/0132091 A1 Apr. 30, 2020

(30) Foreign Application Priority Data

Oct. 24, 2018 (DE) ..... 10 2018 218 218.3

(51) Int. Cl.
*F15B 7/00* (2006.01)
*F15B 11/04* (2006.01)
*F15B 15/18* (2006.01)

(52) U.S. Cl.
CPC ..... *F15B 7/006* (2013.01); *F15B 11/04* (2013.01); *F15B 15/18* (2013.01); *F15B 2211/20515* (2013.01); *F15B 2211/20553* (2013.01); *F15B 2211/20561* (2013.01); *F15B 2211/27* (2013.01); *F15B 2211/30565* (2013.01); *F15B 2211/323* (2013.01); *F15B 2211/613* (2013.01);

(Continued)

(58) Field of Classification Search
CPC ..... F15B 2211/613; F15B 2211/20553; F15B 2211/27; F15B 7/005; F15B 7/006; F16H 61/433; F16H 61/4096; F16H 61/4139
See application file for complete search history.

(56) References Cited

U.S. PATENT DOCUMENTS 5,179,836 A * 1/1993 Dantlgraber ..... F15B 7/006 60/414
7,987,668 B2 * 8/2011 Kakino ..... F15B 15/18 60/452

(Continued)

FOREIGN PATENT DOCUMENTS

DE 10 2012 020 581 A1 4/2014

*Primary Examiner* — Michael Leslie
*Assistant Examiner* — Michael Quandt
(74) *Attorney, Agent, or Firm* — Maginot, Moore & Beck LLP

(57) ABSTRACT

A servohydraulic drive includes a hydrostatic displacement machine, an electric machine that is mechanically speed-coupled with the displacement machine, a hydraulic cylinder that is fluidically connected to the displacement machine via first and second working lines, a hydraulic accumulator, and a supply unit. The displacement machine has a stroke that is adjustable via a hydraulic adjustment device. The cylinder is configured to be activated by reversal of the fluid flow through the displacement machine in opposite directions. The accumulator is preset to a low pressure and is fluidically connected via a valve assembly in each case to the lower pressure working line. The supply unit is configured to supply the adjustment device with pressurized fluid under the necessary pressure for the adjustment regardless of the present pressure in the working lines such that the displacement machine is configured for an active and load pressure-independent adjustment of its stroke volume.

13 Claims, 4 Drawing Sheets

(52) U.S. Cl.
CPC . *F15B 2211/625* (2013.01); *F15B 2211/7053* (2013.01)

(56) References Cited

U.S. PATENT DOCUMENTS

| | | | | |
|---|---|---|---|---|
| 8,033,107 | B2 * | 10/2011 | Tikkanen | F15B 7/006 60/464 |
| 8,341,956 | B2 * | 1/2013 | Makino | F04B 49/002 60/452 |
| 2018/0037310 | A1 * | 2/2018 | Langley | F15B 11/022 |

* cited by examiner

SERVOHYDRAULIC DRIVE

This application claims priority under 35 U.S.C. § 119 to patent application no. DE 10 2018 218 218.3, filed on Oct. 24, 2018 in Germany, the disclosure of which is incorporated herein by reference in its entirety.

BACKGROUND

The disclosure relates to a servohydraulic drive having a hydrostatic displacement machine which is adjustable in its stroke volume by a hydraulic adjustment device, having a speed-controllable electric machine which is mechanically speed-coupled with the displacement machine, having a hydraulic cylinder which is fluidically connected to the displacement machine via a first working line and via a second working line and which can be activated by reversal of the fluid flow through the displacement machine in opposite directions, and having a hydraulic accumulator which is preset to a low pressure and which is fluidically connected via a valve assembly in each case to the working line in which the lower pressure prevails.

Such a servohydraulic drive constituting a hydraulically closed system is known from DE 10 2012 020 581 A1. The hydrostatic displacement machine according to the information in that document is mechanically coupled to an electrical servomotor. An electrical servomotor is the usual term used for electric motors having a regulable speed. Thus, the rotary speed of the displacement machine is also regulable.

Furthermore, according to the specification of DE 10 2012 020 581 A1, the stroke volume of the displacement machine is adjustable. The stroke volume is the amount of pressurized fluid which can be delivered by the displacement machine per revolution, acting as a pump, or the quantity taken in when acting as a motor. No further information about the adjustment device for the stroke volume, in particular no further information about the pressurized fluid supply of the adjustment device, is found in DE 10 2012 020 581 A1.

The problem which the disclosure proposes to solve is to modify the known servohydraulic drive so that the stroke volume of the displacement machine can be adjusted actively and independently of the load.

SUMMARY

This problem is solved in a servohydraulic drive with the aforementioned features by a supply unit, from which the adjustment device can be supplied with pressurized fluid under the necessary pressure for the adjustment regardless of the present pressure in the working lines.

The stroke volume of the hydraulic machine is therefore adjustable in particular so that a small stroke volume can be set at high load pressures, especially in a pressure holding operation, so that the torque produced by the electric motor is not excessively large. Accordingly, two-point control between a maximum stroke volume and a minimum stroke volume is sufficient for the stroke volume, wherein usually the minimum stroke volume is set by a supplying of control fluid to an actuating chamber bounded by an actuating piston of the adjustment device and the maximum stroke volume is set after relieving the actuating chamber of pressure by a spring and possibly by power unit power. It may occur that during rapid travel the load pressure does not reach the minimum pressure necessary for an adjustment, for example 50 bar. If the stroke volume is adjusted only after a rise in the load pressure at the start of a power stroke, this may have negative effect on the quality of a workpiece. Now, according to the disclosure, an active and load-pressure-independent adjusting of the stroke volume of the hydrostatic displacement machine is possible.

Two-point control is obtained in a simple manner in that a switching valve is present, having a first switching position in which the adjustment device is subjected to actuating pressure and having a second switching position in which the hydraulic adjustment device is relieved of pressure to a pressure which is less than a minimum actuating pressure.

The drop in the actuating pressure below the minimum actuating pressure is achieved in a simple manner in that in the second switching position of the switching valve a first port of the switching valve connected to the adjustment device is open to a second port of the switching valve connected to a relief fluid path leading to the low-pressure hydraulic accumulator. This leads to the low-pressure hydraulic accumulator, preferably while bypassing a leakage port of the displacement machine.

Expediently, the switching valve is integrated in the supply unit.

The supply unit can always provide the quantity of control fluid needed for the adjustment, without any dependency on the state and the mode of operation of the main hydraulic circuit comprising the displacement machine and the hydraulic cylinder, if the supply unit comprises an auxiliary pump having a pressure port by which the adjustment device can be supplied with pressurized fluid, and having a suction port which is connected to the low-pressure hydraulic accumulator, and an electric motor, by which the auxiliary pump can be driven. The electric motor drives the auxiliary pump independently of the electric motor which is mechanically coupled to the displacement machine of the main circuit.

It is conceivable in itself to always drive the auxiliary pump only when it is supposed to deliver control fluid, and to shut it down at other times by switching off the electric motor. A return flow of control fluid through the auxiliary pump could be prevented by a check valve blocking the pressure port of the auxiliary pump. However, a modification is preferred whereby the pressure port of the auxiliary pump can be connected to a relief fluid path leading to the low-pressure accumulator. A filter device and/or a cooling device for the pressurized fluid are advantageously situated here. Thus, the auxiliary pump is at least for some of the time a component of a filtration and/or cooling circuit emerging from the low-pressure accumulator and returning to it.

The pressure port of the auxiliary pump can be connected directly to the adjustment device and can be connected via the switching valve to the relief fluid path. This means that the switching valve connects the adjustment device and the auxiliary pump at the same time to the relief fluid path. And it means that the auxiliary pump must maintain the actuating pressure and deliver it against a hydraulic resistance, such as a pressure limiting valve, for as long as the minimum stroke volume is supposed to be set. Only for the adjustment to the maximum stroke volume does the switching valve switch so that the auxiliary pump delivers to the relief fluid path only when the maximum stroke volume is set.

On the contrary, energy losses are reduced if the supply unit comprises an actuating pressure hydraulic accumulator and the switching valve has, besides the first port and the second port, a third port, which is connected to the actuating pressure hydraulic accumulator, wherein the first port of the switching valve in its first switching position is connected to the third port and in the second switching position of the switching valve is connected to the second port. Thus, the switching valve connects the adjustment device either to the actuating pressure hydraulic accumulator or to the relief fluid path, while in the first switching position of the switching valve the actuating pressure hydraulic accumulator can maintain the necessary actuating pressure without energy losses.

The actuating pressure hydraulic accumulator is advantageously chargeable from the auxiliary pump.

In one preferred modification, for this purpose a second switching valve is present, having a first port which is connected to the pressure port of the auxiliary pump, and a first switching position in which the auxiliary pump is connected to the actuating pressure hydraulic accumulator via the second switching valve of the pressure port, and having a second switching position in which the auxiliary pump is connected to a relief fluid path leading to the low-pressure hydraulic accumulator via the second switching valve of the pressure port.

The actuating pressure hydraulic accumulator may also be charged from the working line respectively conducting the higher pressure, instead of from an auxiliary pump. Under certain circumstances, this accumulator charging is possible only in the fully extended or fully retracted position of the hydraulic cylinder, since in these positions a sufficiently large load pressure can be built up.

The actuating pressure hydraulic accumulator may also be designed as a pressure booster having a large piston face, adjacent to a low-pressure chamber, and having a small piston face, adjacent to a high-pressure chamber and mechanically connected to the large piston face, wherein the low-pressure chamber is connected to the low-pressure hydraulic accumulator and the high-pressure chamber is connected to the third port of the switching valve whose first port is connected to the adjustment device. The actuating pressure hydraulic accumulator is then in principle a piston-type accumulator having a differential piston, which is subjected at the large face to the largely constant low pressure prevailing in the low-pressure hydraulic accumulator. By the force created on the large piston by the largely constant low pressure is independent of the position of the piston faces and preloads the actuating pressure fluid upstream from the small piston face to the necessary actuating pressure. The accumulator is filled, supplying the high-pressure chamber with actuating pressure fluid, whereupon the piston faces are moved and the volume of the high-pressure chamber increases and the volume of the low-pressure chamber decreases.

BRIEF DESCRIPTION OF THE DRAWINGS

Four exemplary embodiments of a servohydraulic drive according to the disclosure are represented as a hydraulic circuit in the drawings. The disclosure shall now be explained more closely with the aid of these drawings.

In the Figures.

DETAILED DESCRIPTION

Figure 1:
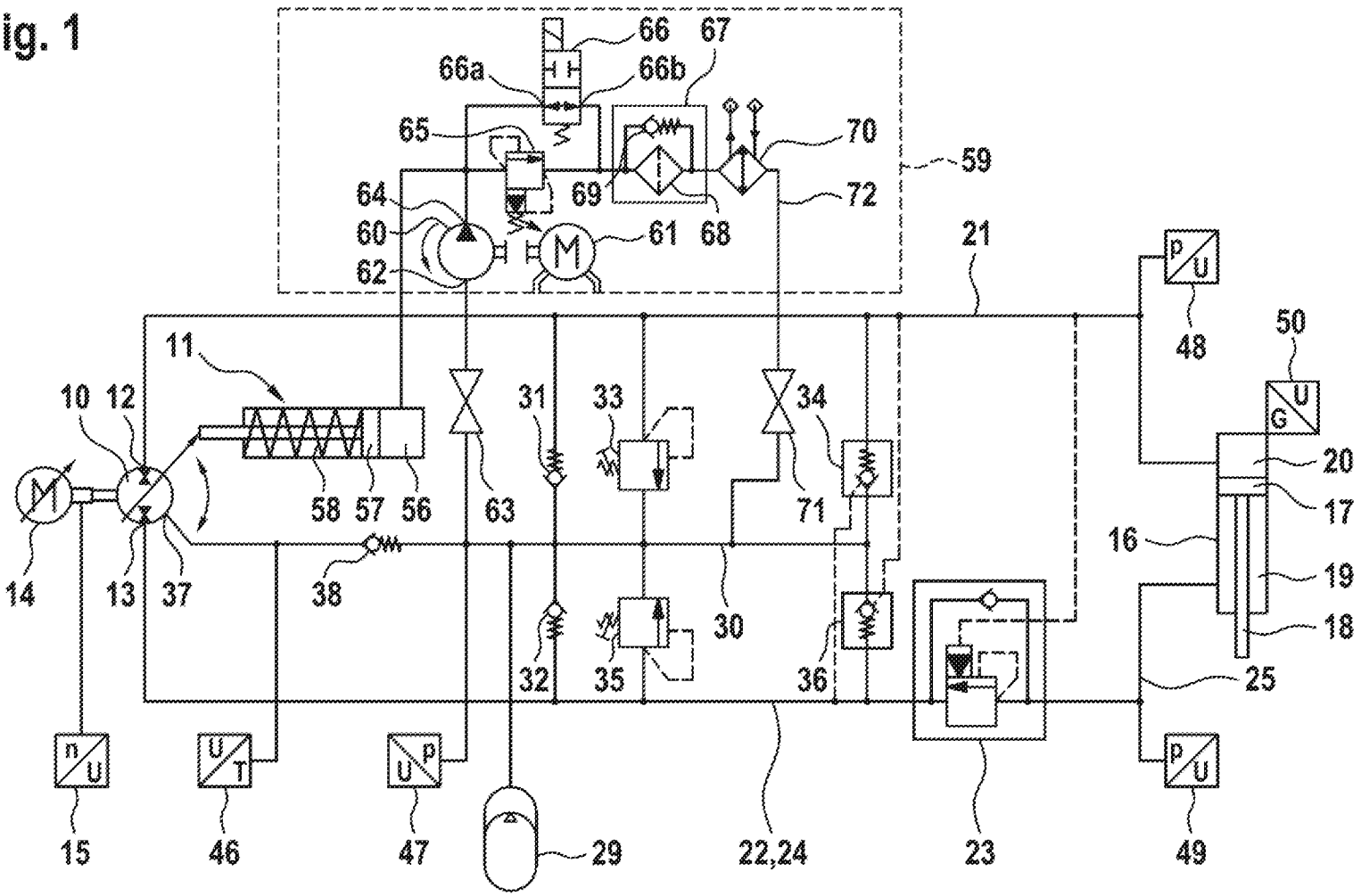
FIG. 1 shows the first exemplary embodiment, in which an auxiliary pump directly supplies the adjustment device with pressure fluid.

In all four exemplary embodiments, the servohydraulic drive comprises a hydrostatic displacement machine 10, which can be operated both as a pump and also as a motor and whose stroke volume can be adjusted with the aid of an adjustment device 11 between a minimum value and a maximum value. The displacement machine has a first working port 12 and a second working port 13 and is for example an axial piston machine in swash plate design, in which the stroke volume is adjusted by a pivoting of the swash plate. To the displacement machine there is mechanically coupled, without an interposed gearing, a variable-speed electric machine 14, wherein, by means of this coupling, the electric machine when operating as a motor can drive the displacement machine in both directions of rotation in its operation as a pump, and when operating as a generator can be driven in both directions of rotation by the displacement machine operating as a motor. The rotary speed of the machine combination consisting of the displacement machine and the electric machine is detected by a speed sensor 15.

The servohydraulic drive furthermore comprises a hydraulic cylinder 16, which is designed as a differential cylinder having a piston 17 and a one-sided piston rod 18 and is thus designed with a piston-rod-side, ring-shaped cylinder chamber 19 and with a piston-rod-averted cylinder chamber 20 shaped as a circular disk in cross section. The cylinder chamber 20 is connected without an interposed valve directly via a working line 21 to the working port 12 of the displacement machine 10. In a working line 22 between the working port 13 of the displacement machine 10 and the cylinder chamber 19 of the hydraulic cylinder 16 there is situated a lowering brake valve 23, which combines in itself multiple functions, namely, the holding of a load pulling on the piston rod 18 of the hydraulic cylinder, the limiting of the pressure occurring in the cylinder chamber 19, the controlling for a desired lowering of a load, and a check valve function for the lifting of a load. The lowering brake valve 23 divides the working line 22 into a section near the displacement machine 24 and a section near the cylinder 25.

The servohydraulic drive furthermore comprises a hydropneumatic accumulator 29, called for short in the following a hydraulic accumulator, which is designed for example as a bladder accumulator or membrane accumulator and which is preset to a low pressure of, for example, 5 bar. The hydraulic accumulator 29 is connected to a low-pressure collecting line 30. This is fluidically connected to the working line 21 via a check valve 31, opening toward said working line 21, and to the section of the working line 22 situated between the working port 13 and the lowering brake valve 23 via a check valve 32 opening toward said working line 22. Between the low-pressure collecting line 30 and the working line 21 are furthermore situated a pressure limiting valve 33, by which the pressure in the working line 21 and thus that in the cylinder chamber 20 is limited to a maximum value, and a releasable check valve 34, which opens toward the working line 21 and is releasable by a pressure in the section 24 of the working line 22. After a releasing of the releasable check valve 34, pressure fluid can flow from the working line 21 to the low-pressure collecting line 30 and thus to the hydraulic accumulator 29. Between the low-pressure collecting line 30 and the section 24 of the working line 22 there are furthermore situated a pressure limiting valve 35, by which the pressure in the section 24 of the working line 22 and thus in the cylinder chamber 19 is limited to a maximum value, and a releasable check valve 36, which opens toward the section 24 of the working line 21 and is releasable by a pressure in the working line 21. After a releasing of the releasable check valve 36, pressure fluid can flow from the section 24 of the working line 21 to the low-pressure collecting line 30.

The check valve 31 and the pressure limiting valve 33 as well as the check valve 32 and the pressure limiting valve 35 are usually in each case combined into a so-called pressure replenishing valve.

Finally, a leakage port 37 of the displacement machine 10 is fluidically connected via a check valve 38 opening toward the low-pressure collecting line 30 and thus toward the hydraulic accumulator 29 to the hydraulic accumulator 29.

Various sensors serve for the monitoring and the control of the servohydraulic drive. With the speed sensor 15, as already mentioned, the rotary speed of the hydrostatic displacement machine 10 and the electric machine 14 is detected. With a temperature sensor 46, the temperature of the leakage fluid flowing from the displacement machine 10 to the low-pressure collecting line 30 is detected. With a pressure sensor 47, the pressure in the low-pressure collecting line 30 and thus in the hydraulic accumulator 29 is detected. With a pressure sensor 48, the pressure in the cylinder chamber 20 is detected. With a pressure sensor 49, the pressure in the cylinder chamber 19 is detected. With an acceleration sensor 50, the acceleration of the piston 17 of the hydraulic cylinder 16 is detected. From the acceleration, the velocity can be calculated by integration, and by a further integration the position of the piston 17.

The adjustment device 11 for the stroke volume of the displacement machine 10 comprises an actuating cylinder 55, in which an actuating piston 57 adjacent to an actuating chamber 56 can move in the lengthwise direction. The actuating piston 57 is mechanically connected to the swash plate of the displacement machine 10 in such a way that a pressure force can be exerted by it on the swash plate in order to turn the swash plate about a swivel axis and move it into the position with small stroke volume. Acting counter to the force exerted by the actuating piston 57 on the swash plate, and in the opposite swivel direction of the swash plate, are the force of a return spring 58, which, contrary to the schematic illustration in the figures, is supported not against the activating piston but instead directly against the swash plate, and, on account of an eccentric arrangement of the swivel axis relative to the axis of rotation of the drive shaft of the displacement machine 10, in particular the power unit forces. A supply unit 59 serves for the supplying of the adjustment device 11 with pressure fluid. For this, in the exemplary embodiment per FIG. 1, an auxiliary pump 60 with a constant stroke volume is provided, which can be driven by a simple electric motor 61 in a single direction of rotation. The auxiliary pump 60 has a suction port 62, which is connected via a manually activatable valve 63 to the low-pressure collecting line 30, and a pressure port 64, to which the actuating chamber 56, a pressure limiting valve 65, and a first port 66*a* of a 2/2-way valve 66 situated in the bypass past the pressure limiting valve 65 are connected. The directional valve 66 under the action of a compression spring assumes an opened rest position and can be switched electromagnetically into a blocked position. Downstream from the pressure limiting valve 65 and a second port 66*b* directional valve 66, there are situated in a relief fluid path 72 in series with each other a filter device 67 having a filter element 68 and having a bypass check valve 69 situated in the bypass past the filter element, which bypass check valve opens when the pressure drop across the filter element exceeds a certain value, and a cooling device 70 downstream from the filter device 67. Pressure fluid cooled in the cooling device 70 flows via a manually activatable valve 71 situated in the relief fluid path 72 into the low-pressure collecting line 30.

It shall now be assumed that, in the exemplary embodiment of FIG. 1, the displacement machine 10 is set at maximum stroke volume and pressure fluid is being delivered into the working line 21 and thus into the cylinder chamber 20. The load pressure is at first low. The directional valve 66 is open. The auxiliary pump 60 is driven by the electric motor 61 and delivers pressure fluid from the low-pressure collecting line 30 via the directional valve 66, the filter device 67 and the cooling device 70 back to the low-pressure collecting line, while the pressure at the pressure port 64 and thus in the actuating chamber 56 is only slightly above the low pressure, due to the hydraulic resistances of the filter device 67 and the cooling device 70. If the resistance to a further extending of the piston rod 18 and thus the load pressure increases, the displacement machine should be adjusted to the minimum stroke volume. For this, the directional valve 66 is closed. The pressure at the pressure port 64 of the auxiliary pump 60 and thus in the actuating chamber 56 increases and reaches the level necessary for the adjustment, such as 50 bar, so that the actuating piston 57 extends and the swash plate swivels against the force of the return spring 58 and against the power unit forces. The pressure in the actuating chamber 56 is limited by the pressure limiting valve 65 to a value slightly above the maximum necessary actuating pressure.

If the displacement machine is to be adjusted once more to the maximum stroke volume, the directional valve 66 is opened. As a result, the actuating chamber 56 is relieved of pressure and the return spring and the power unit forces are able to swivel the swash plate back to maximum stroke volume.

Figure 2:
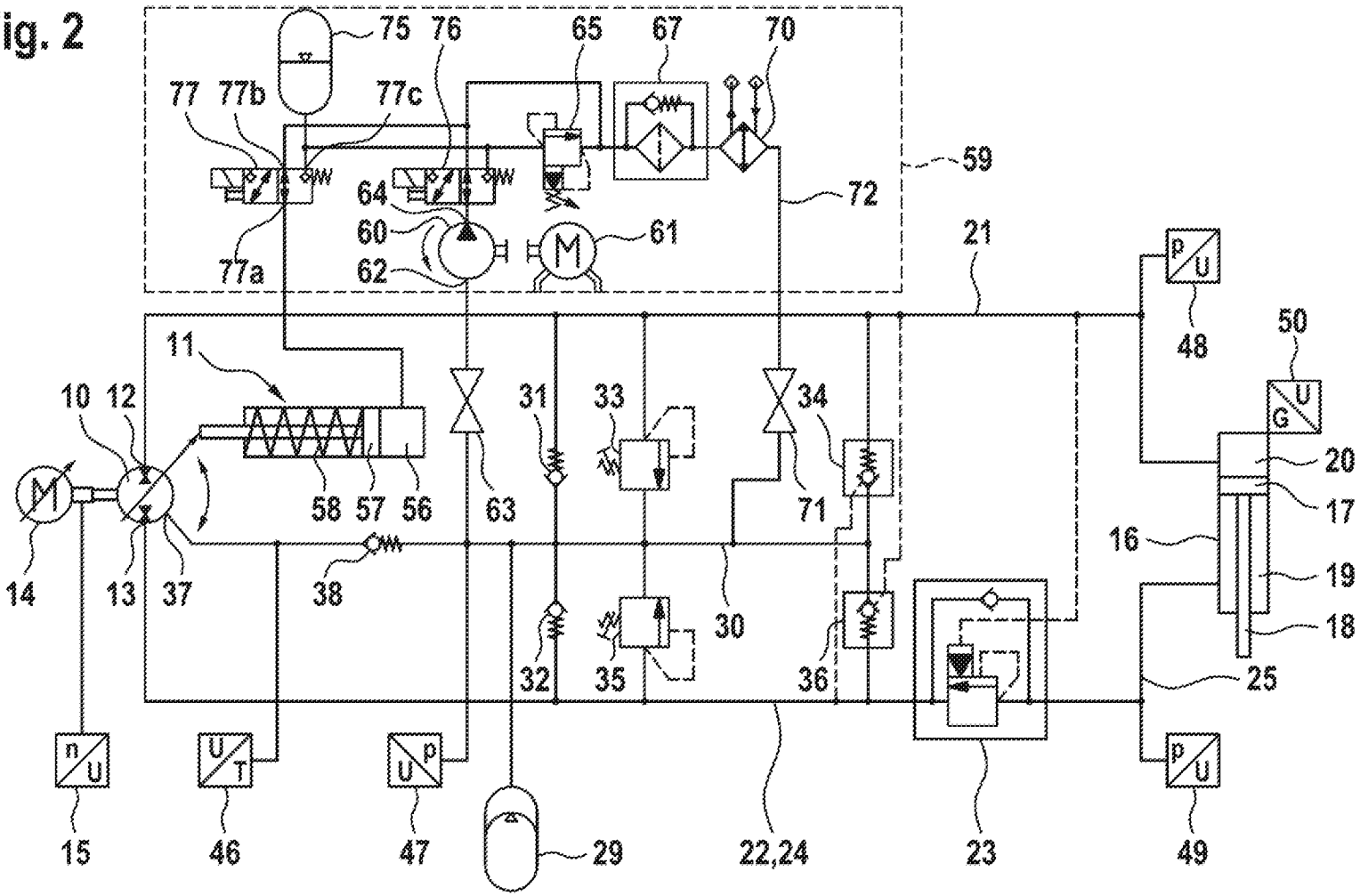
FIG. 2 shows the second exemplary embodiment, in which an actuating pressure hydraulic accumulator is chargeable from the auxiliary pump.

Whereas in the exemplary embodiment of FIG. 1 the pressure port 64 of the auxiliary pump 60 is connected directly to the actuating chamber 56, the exemplary embodiment of FIG. 2 comprises an actuating pressure hydraulic accumulator 75 in the pressurized fluid supply for the adjustment device 11. A 3/2-way switching valve 76 is present, which connects the pressure port 64 of the auxiliary pump 60, in a rest position which said valve assumes under the action of a spring, to the series circuit of the filter device 67 and the cooling device 70, bypassing a pressure limiting valve 65 present as in the exemplary embodiment of FIG. 1, and, in an activated switching position, to the actuating pressure hydraulic accumulator 75. The pressure limiting valve 65 is connected to this connection between the directional valve 76 and the actuating pressure hydraulic accumulator 75 and limits the accumulator pressure.

A further 3/2-way switching valve 77 is present, which connects the actuating chamber 56 via a first port 77*a* and a second port 77*b*, in a rest position, to the bypass past the pressure limiting valve 65 and via the first port 77*a* and a third port 77*c*, in a switched position, to the actuating pressure hydraulic accumulator 75.

It shall now be assumed once again that, in the exemplary embodiment of FIG. 2, the displacement machine 10 is set to maximum stroke volume and pressure fluid is being delivered to the working line 21 and thus to the cylinder chamber 20. The load pressure is at first low. The directional valves 76 and 77 are in their rest positions, as shown in FIG. 2, so that the auxiliary pump bypasses the pressure limiting valve 65 and delivers to the filtering and cooling circuit, and the actuating chamber 56 is relieved of pressure. If the resistance to a further extending of the piston rod 18 and thus the load pressure increases, the displacement machine should be adjusted to the minimum stroke volume. For this, the directional valve 77 is switched over, so that the actuating chamber 56 is connected to the actuating pressure hydraulic accumulator 75. The pressure in the actuating chamber 56 increases to the accumulator pressure, so that the actuating piston 57 extends and the swash plate swivels against the force of the return spring 58 and against the power unit forces. The directional valve 76 is switched over for the charging of the actuating pressure hydraulic accumulator 75, so that the actuating pressure hydraulic accumulator 75 is connected to the pressure port of the auxiliary pump 60. This charging of the actuating pressure hydraulic accumulator 75 can occur at any time within a movement cycle of the hydraulic cylinder 16. The pressure in the actuating pressure hydraulic accumulator 75 can be limited by the pressure limiting valve 65 to a value making possible one or more setting sequences with no additional charging.

If the displacement machine is to be adjusted once more to the maximum stroke volume, the directional valve 77 is placed in its rest position as shown in FIG. 2. As a result, the actuating chamber 56 is relieved of pressure and the return spring and the power unit forces are able to swivel the swash plate back to maximum stroke volume.

Figure 3:
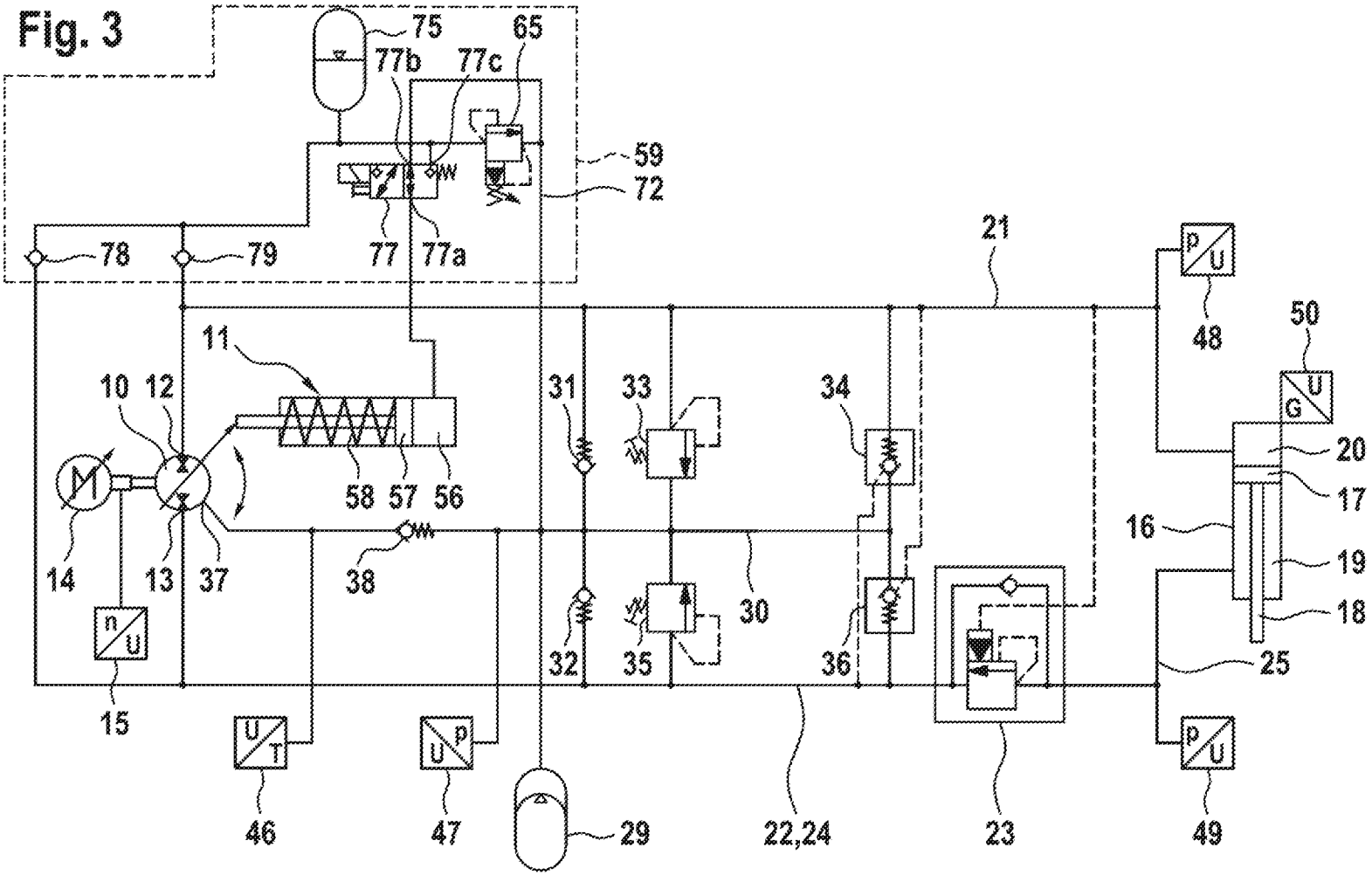
FIG. 3 shows the third exemplary embodiment, in which an actuating pressure hydraulic accumulator is charged from the working lines, and an actuating pressure hydraulic accumulator is chargeable from the auxiliary pump.

In the exemplary embodiment of FIG. 3, no auxiliary pump and no filter device and no cooling device are provided. The actuating pressure hydraulic accumulator 75 designed as a bladder accumulator or as a membrane accumulator as in the exemplary embodiments of FIGS. 1 and 2 is charged via a selector circuit, consisting of two check valves 78 and 79, respectively from the working port 12 or 13 of the displacement machine 10 in which the higher pressure is present relative to the other working port. The pressure limiting valve 65 in the exemplary embodiment of FIG. 3, with its inlet connected to the actuating pressure hydraulic accumulator 75 and with its outlet connected to the low-pressure collecting line 30, serves for the mere safeguarding of the accumulator and should as far as possible not be triggered, since when the pressure limiting valve is triggered pressure fluid would be removed needlessly from the working lines. As in the exemplary embodiment of FIG. 2, a 3/2-way switching valve 77 is present. The actuating chamber 56 of the adjusting device 11 is connected in the rest position of the directional switching valve 77 to the low-pressure collecting line 30 and thus is relieved of pressure. In the activated switching position of the directional switching valve 77, the actuating chamber 56 is connected to the actuating pressure accumulator 75 and thus subjected to the high accumulator pressure. Hence, by switching over the directional valve 77, the displacement machine is adjusted from minimum stroke volume to maximum stroke volume and vice versa.

Figure 4:
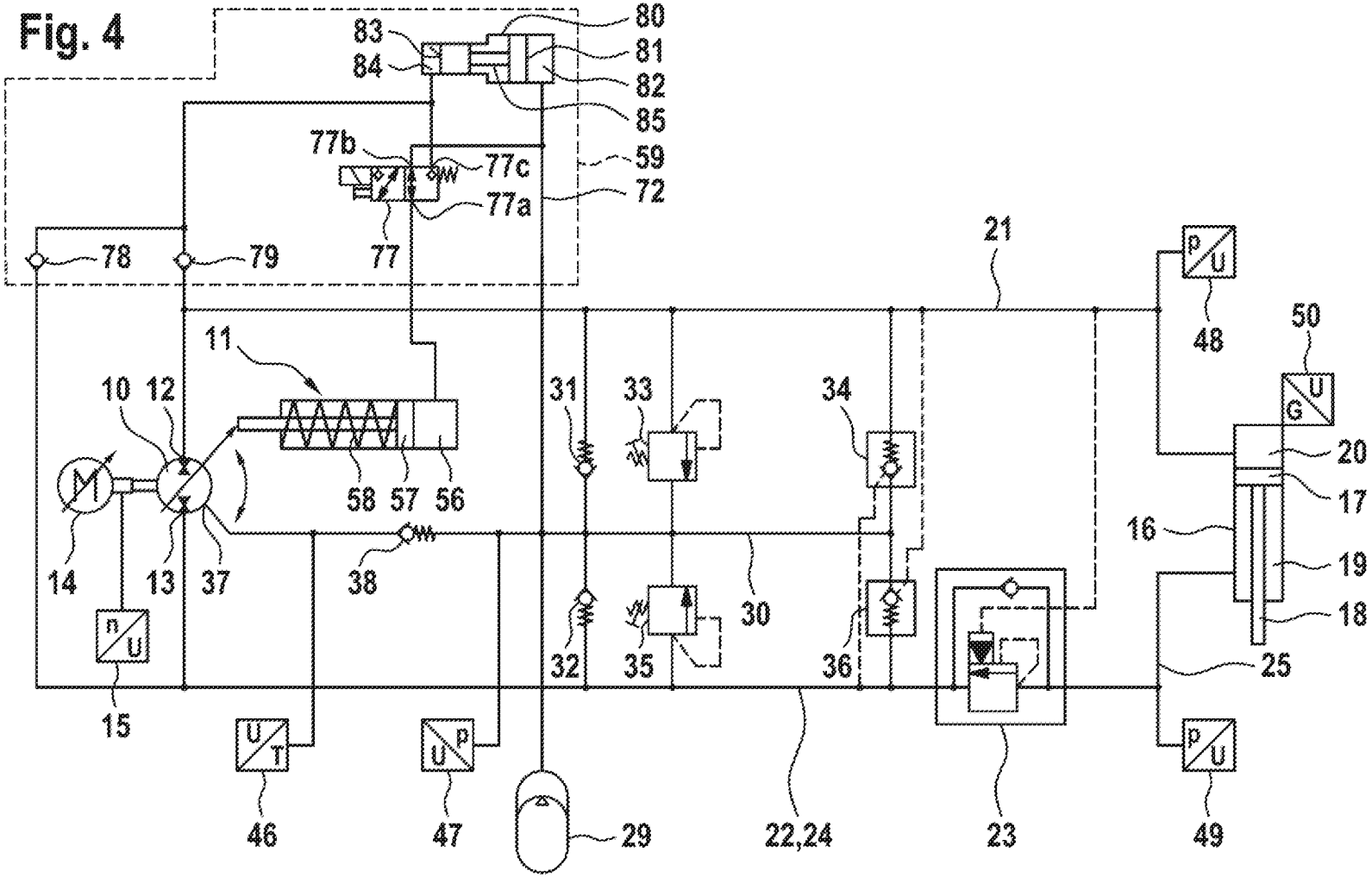
FIG. 4 shows the fourth exemplary embodiment, in which an actuating pressure hydraulic accumulator is designed as a pressure booster.

In the exemplary embodiment of FIG. 4, the actuating pressure hydraulic accumulator is designed as a pressure booster 80 having a large piston face 81, adjacent to a low-pressure chamber 82 connected to the low-pressure collecting line 30 and thus to the low-pressure accumulator, and having a small piston face 83, adjacent to a high-pressure chamber 84 and mechanically connected to the large piston face 81. The piston faces 81 and 83 are located on a stepped piston 85, with the space at the step being relieved to the atmosphere. As in the exemplary embodiment of FIG. 3, the high-pressure chamber 84 of the pressure booster 80 is charged via a selector circuit consisting of two check valves 78 and 79 respectively from the working port 12 or 13 of the displacement machine 10 in which the higher pressure prevails compared to the other working port.

As in the exemplary embodiment of FIGS. 2 and 3, a 3/2-way switching valve 77 is present. The actuating chamber 56 of the adjustment device 11 in the rest position of the directional switching valve 77 is connected to the low-pressure collecting line 30 and thus relieved of pressure. In the activated switching position of the directional switching valve 77, the actuating chamber 56 is connected to the high-pressure chamber 84 of the pressure booster 80 and thus subjected to high pressure. Hence, by switching over the directional switching valve 77, the displacement machine is adjusted from minimum stroke volume to maximum stroke volume and vice versa.

If it is assumed that the ratio between the large piston face 81 and the small piston face 83 is equal to 10 and the low pressure in the low-pressure hydraulic accumulator 29 is 5 bar, then at equilibrium of forces there is a pressure of 50 bar on the stepped piston 85 in the high-pressure chamber 84. If the pressure on one of the working ports 12 or 13 of the displacement machine is higher than 50 bar, pressure fluid will flow via the corresponding check valve 78 or 79 to the high-pressure chamber. The stepped piston 85 will be displaced, under decreasing volume of the low-pressure chamber 82, as far as an end stop, so that the pressure in the high-pressure chamber will increase, under compression of the pressure fluid in the high-pressure chamber 84, up to a maximum pressure which is present at the working port with the higher pressure. After this, the displacement machine 10 can be adjusted from the large stroke volume to the small stroke volume, even if the actuating pressure needed for the adjustment is present neither at the working port 12 nor at the working port 13 of the displacement machine. During an adjustment, compression pressure fluid will at first be consumed, before then, with further consumption of pressure fluid during the present or a subsequent adjustment, the stepped piston 85 of the pressure booster moves so as to reduce the volume of the high-pressure chamber and maintaining a pressure of 50 bar in the high-pressure chamber 84 of the pressure booster.

In the two exemplary embodiments of FIGS. 3 and 4, the charging of the actuating pressure hydraulic accumulator 75 or 80 is only possible in defined positions of the hydraulic cylinder 16, especially in the positions in which the piston rod 18 is fully retracted or fully extended, and/or when a sufficiently high pressure (load pressure) is present at the two check valves.

LIST OF REFERENCE NUMBERS

10 Hydrostatic displacement machine
11 Adjustment device for stroke volume
12 First working port of 10
13 Second working port of 10
14 Electric machine
15 Speed sensor
16 Hydraulic cylinder
17 Piston of 16
18 Piston rod of 16
19 Piston-rod-side cylinder chamber of 16
20 Piston-rod-averted cylinder chamber of 16
21 Working line
22 Working line
23 Lowering brake valve

24 Section of 22
25 Section of 22
29 Hydraulic accumulator
30 Low-pressure collecting line
31 Check valve
32 Check valve
33 Pressure limiting valve
34 Releasable check valve
35 Pressure limiting valve
36 Releasable check valve
37 Leakage port of 10
46 Temperature sensor
47 Pressure sensor
48 Pressure sensor
49 Pressure sensor
50 Acceleration sensor
55 Actuating cylinder
56 Actuating chamber
57 Actuating piston
58 Return spring
58 Supply unit
60 Auxiliary pump
61 Electric motor
62 Suction port of 60
63 Valve
64 Pressure port of 60
65 Pressure limiting valve
66 2/2-way valve
66*a* First port of 66
66*b* Second port of 66
67 Filter device
68 Filter element of 67
69 Bypass check valve of 67
70 Cooling device
71 Valve
72 Relief fluid path
75 Actuating pressure hydraulic accumulator
76 3/2-way switching valve
77 3/2-way switching valve
77*a* First port of 77
77*b* Second port of 77
77*c* Third port of 77
80 Pressure booster
81 Large piston face of 80
82 Low-pressure chamber of 80
83 Small piston face of 80
84 High-pressure chamber
85 Stepped piston of 80

What is claimed is:

1. A servohydraulic drive, comprising:

a hydrostatic displacement machine having a stroke volume;

a hydraulic adjustment device configured to adjust the stroke volume;

an electric machine that is mechanically speed-coupled with the displacement machine;

a hydraulic cylinder that is fluidically connected to the displacement machine via a first working line and a second working line, the hydraulic cylinder configured to be activated by reversal of the fluid flow through the displacement machine in opposite directions;

a low-pressure hydraulic accumulator that is preset to a low pressure and fluidically connected via a valve assembly in each case to one of the first and second working lines in which the lower pressure prevails; and a supply unit including a switching valve configured to supply the adjustment device with pressurized fluid having an actuating pressure sufficient to adjust the hydraulic adjustment device, the supply unit configured to supply the actuating pressure independently of a present pressure in the first and second working lines, the switching valve having (i) a first switching position in which the hydraulic adjustment device is subjected to the actuating pressure and (ii) a second switching position in which the hydraulic adjustment device is relieved of pressure to a pressure that is less than a minimum actuating pressure, wherein, in the second switching position, a first port of the switching valve connected to the hydraulic adjustment device is open to a second port of the switching valve connected to a relief fluid path leading to the low-pressure hydraulic accumulator.

2. The servohydraulic drive according to claim 1, wherein the relief fluid path leads to the low-pressure hydraulic accumulator while bypassing a leakage port of the displacement machine.

3. The servohydraulic drive according to claim 1, wherein the supply unit includes an actuating pressure hydraulic accumulator, wherein the switching valve has a third port that is connected to the actuating pressure hydraulic accumulator, and wherein the first port of the switching valve is connected to (i) the third port in the first switching position and (ii) the second port in the second switching position.

4. The servohydraulic drive according to claim 3, wherein the actuating pressure hydraulic accumulator is charged from one of the first and second working lines in which the higher pressure is conducted.

5. The servohydraulic drive according to claim 3, wherein:

the actuating pressure hydraulic accumulator is configured as a pressure booster having (i) a first piston face that is adjacent to a first pressure chamber and (ii) a second piston face that is adjacent to a second pressure chamber and is mechanically connected to the first piston face, the first piston face being larger than the second piston face and the first pressure chamber having a lower pressure than the second pressure chamber, and the first pressure chamber is connected to the low-pressure hydraulic accumulator and the second pressure chamber is connected to the third port of the switching valve.

6. A servohydraulic drive, comprising:

a hydrostatic displacement machine having a stroke volume;

a hydraulic adjustment device configured to adjust the stroke volume;

an electric machine that is mechanically speed-coupled with the displacement machine;

a hydraulic cylinder that is fluidically connected to the displacement machine via a first working line and a second working line, the hydraulic cylinder configured to be activated by reversal of the fluid flow through the displacement machine in opposite directions;

a low-pressure hydraulic accumulator that is preset to a low pressure and fluidically connected via a valve assembly in each case to one of the first and second working lines in which the lower pressure prevails; and a supply unit configured to supply the adjustment device with pressurized fluid having an actuating pressure sufficient to adjust the hydraulic adjustment device, the supply unit configured to supply the actuating pressure independently of a present pressure in the first and second working lines, wherein the supply unit includes an auxiliary pump and an electric motor configured to drive the auxiliary pump, the auxiliary pump having (i) a pressure port by which the hydraulic adjustment device is supplied with the pressurized fluid and (ii) a suction port that is connected to the low-pressure hydraulic accumulator.

7. The servohydraulic drive according to claim 6, further comprising a switching valve that has (i) a first switching position in which the hydraulic adjustment device is subjected to actuating pressure and (ii) a second switching position in which the hydraulic adjustment device is relieved of pressure to a pressure that is less than a minimum actuating pressure.

8. The servohydraulic drive according to claim 7, wherein the switching valve is integrated in the supply unit.

9. The servohydraulic drive according to claim 6, wherein the pressure port of the auxiliary pump is configured to be connected to a relief fluid path leading to the low-pressure hydraulic accumulator.

10. The servohydraulic drive according to claim 9, wherein one or more of a filter device and a cooling device configured for the pressurized fluid is situated in the relief fluid path.

11. The servohydraulic drive according to claim 9, wherein the pressure port of the auxiliary pump is connected directly to the hydraulic adjustment device and is configured to be connected via the switching valve to the relief fluid path.

12. The servohydraulic drive according to claim 6, further comprising a switching valve that has (i) a first switching position in which the hydraulic adjustment device is subjected to the actuating pressure and (ii) a second switching position in which the hydraulic adjustment device is relieved of pressure to a pressure that is less than a minimum actuating pressure, wherein, in the second switching position, a first port of the switching valve connected to the hydraulic adjustment device is open to a second port of the switching valve connected to a relief fluid path leading to the low-pressure hydraulic accumulator, wherein the supply unit includes an actuating pressure hydraulic accumulator, wherein the switching valve has a third port that is connected to the actuating pressure hydraulic accumulator, wherein the first port of the switching valve is connected to (i) the third port in the first switching position and (ii) to the second port in the second switching position, and wherein the actuating pressure hydraulic accumulator is configured to be charged by the auxiliary pump.

13. The servohydraulic drive according to claim 12, further comprising a second switching valve that has (i) a third switching position in which the auxiliary pump is connected to the actuating pressure hydraulic accumulator via the second switching valve of the pressure port and (ii) a fourth switching position in which the auxiliary pump is connected to the relief fluid path leading to the low-pressure hydraulic accumulator via the second switching valve of the pressure port.

* * * * *